US005142875A

United States Patent [19]

James et al.

[11] Patent Number: 5,142,875

[45] Date of Patent: Sep. 1, 1992

[54] COOLED PUMPING SYSTEM

[75] Inventors: Michael S. James, New Castle, Del.; Meliss A. Powell, West Chester, Pa.; Mark A. Nickerson, Landenberg, Pa.; Louis T. Staats, III, Lincoln University, Pa.

[73] Assignee: Hewlett-Packard Company, Palo Alto, Calif.

[21] Appl. No.: 662,687

[22] Filed: Mar. 1, 1991

[51] Int. Cl.[5] ..... F17C 9/02

[52] U.S. Cl. ..... 62/50.5; 62/505; 417/228; 417/372

[58] Field of Search ..... 62/50.5, 505; 417/228, 417/372

[56] References Cited

U.S. PATENT DOCUMENTS

| | | | |
|---|---|---|---|
| 3,131,045 | 4/1964 | Schilling | 62/50.6 |
| 4,006,602 | 2/1977 | Fanberg | 62/505 |
| 4,224,798 | 9/1980 | Brinkeroff | 417/228 |
| 4,242,878 | 1/1981 | Brinkeroff | 62/505 |
| 4,254,637 | 3/1981 | Brauch et al. | 62/505 |
| 4,311,917 | 1/1982 | Hencey, Jr. et al. | 62/505 |
| 4,432,209 | 2/1984 | Landry et al. | 62/505 |
| 4,559,786 | 12/1985 | Schuck | 62/50.6 |
| 4,570,578 | 2/1986 | Peschka et al. | 62/50.6 |
| 4,932,214 | 1/1990 | Nieratscher et al. | 62/505 |

*Primary Examiner*—Ronald C. Capossela
*Attorney, Agent, or Firm*—Richard F. Schuette

[57] ABSTRACT

A method and apparatus for accurately regulating the compressibility of a compressible fluid in a pumping system utilizing a single zone of controlled cooling. Cryogenic cooling is employed for cooling a pump head and a thermally integrated heat exchanger such that a single source of cryogenic fluid can be applied to the heat exchanger to increase the bulk modulus of the compressible fluid just prior to and during the pumping process.

4 Claims, 4 Drawing Sheets

COOLED PUMPING SYSTEM

BACKGROUND OF THE INVENTION

In a pumping system for highly compressible fluids, an important feature is the ability to keep the pump head of the pumping apparatus and the pumping fluid at a very low temperature to reduce the compressibility of the pumping fluid prior to pumping. Additionally, it is an important feature to stabilize fluid flow and to reduce flow ripple by maintaining the pumping fluid at a constant temperature. Currently, there is intense interest in using near-critical and supercritical fluids at elevated pressures as solvents in extraction systems and in chromatographic systems. Often the solvents of interest exist as highly compressible fluids at ambient pressures and temperatures from 15–40 degrees centigrade. At ambient conditions, fluids such as carbon dioxide, ethylene, ethane and sulfur hexafluoride have high vapor pressures which significantly exceed 1 atmosphere. However, those pressures are not sufficiently high for extraction and chromatographic applications at or near supercritical conditions. Therefore, gaseous or liquid state fluids must be supplied to some type of pumping system to meet pressure and flow requirements of the high pressure processes downstream of the pumping system.

Compressing and injecting compressible fluids into a high pressure system at mass flow rates in the range of 0.2 g/min to 10 g/min (for $CO_2$) is very difficult. A multiple compressor pump system may be used for this purpose or the gas may be condensed by removing the heat of vaporization. Once the fluid in the gaseous phase is liquified, the fluid may be introduced into the pumping system to ensure constant mass flow rates. Since extraction or chromatographic compressible solvent fluids are typically supplied in the liquid phase from a pressurized tank, a pressure drop generally arises prior to entering the pump. Flashing may occur where fluid in the liquid phase could then be mixed with fluid in the gas phase resulting in a two phase fluid mixture which is more compressible than the original signal phase fluid. Therefore, the efficiency and metering accuracy of a solvent delivery system can be greatly enhanced by decreasing the compressibility and hence increasing the bulk modulus of the fluid by precisely maintaining the pumping fluid at sub-ambient conditions. Another alternative would be to increase the compression ratio of the pump.

Current solvent delivery systems utilize syringe pumps with pumping cylinders having large compression ratios. A major drawback of such systems is the need to interrupt the chromatographic process to refill the cylinder once it is empty. Current reciprocating, diaphragm pumps or compressors require large compression ratios and are relatively large in implementation.

In order to decrease the compressibility of the fluid and thereby decrease the corresponding compression ratio so that liquid-type pumps with continuous flow capability can be used, it is necessary to pre-cool the compressible fluid prior to entry into the pump. Heat exchangers and cooling baths are typically employed for this purpose. Furthermore, it is also necessary to cool the pump head separately to keep the compressibility of the fluid constant at a low value during the pumping process. However, this typically requires the use of a complicated system incorporating two thermal cooling zones.

Pre-cooling of the pumping fluid 1 to sub-ambient temperatures has been accomplished by feeding the pumping fluid through a heat exchanger 2 of a precooler 4 placed in a recirculating bath 5 containing a cooled liquid having a temperature regulated by a thermocouple 6 (see FIG. 1). The cooled liquid is also circulated to the pump head 7 by a recirculating pump 8 to keep it at sub-ambient temperatures. However, this approach requires a lot of equipment and makes it difficult to accurately regulate the temperature of both the pumphead and the pre-cooler at the same time. Another problem associated with this apparatus is maintaining constant temperature of the pumping fluid once it leaves the precooler 4 and flows to the pumphead. The plumbing in between is very insulated, however, the fluid still cannot maintain constant temperature because of significant thermal interaction with the environment. The same problem is true with respect to the recirculating cooling fluid for the pumphead. Since the cooling source is remote from the pumphead, thermal inefficiencies are encountered. FIG. 2 is a more detailed view of the pumphead and illustrates problems associated with cooling the pumphead and the pumping fluid separately.

It is, therefore, desirable to eliminate the need for two controlled zones of cooling such as a recirculating bath or cryogenic cooling.

In particular, it would be desirable if the need for a recirculating bath could be eliminated completely.

SUMMARY OF THE INVENTION

It is, therefore, a primary object of this invention to provide a method and apparatus for accurately regulating the compressibility of a compressible fluid in a pumping system without utilizing two zones of controlled cooling as for example, with a recirculating bath. It is another object of the invention to provide a low maintenance method and apparatus for reducing and accurately regulating the compressibility of a compressible fluid in a pumping system.

In accordance to the above, the invention provides for cryogenic cooling of a pump head having a much higher thermal conductivity than the rest of the pump body. A heat exchanger is coupled integrally to the pump head such that a single source of cryogenic fluid can be applied to the heat exchanger to increase the bulk modulus of the compressible fluid in the pumping system by cooling the pump head simultaneously with the pumping fluid just prior to being pumped.

The foregoing and other object, features and advantages of the invention will be apparent from the following more particular description of preferred embodiments of the invention as illustrated in the accompanying drawings.

DESCRIPTION OF THE PREFERRED EMBODIMENT

Figure 1:
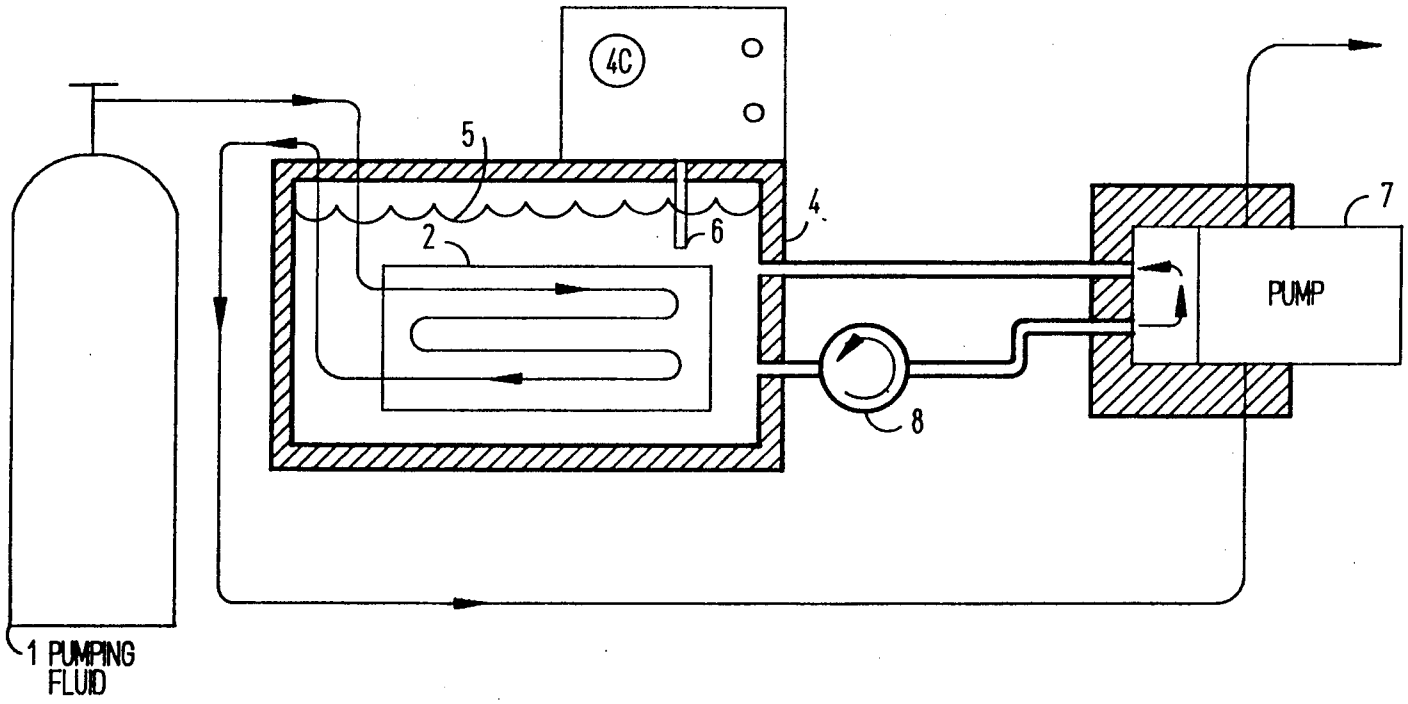
FIG 1 (PRIOR ART)
FIG. 1 illustrates the prior art fluid pumping system employing a recirculating bath and two cooled zones.
Figure 2:
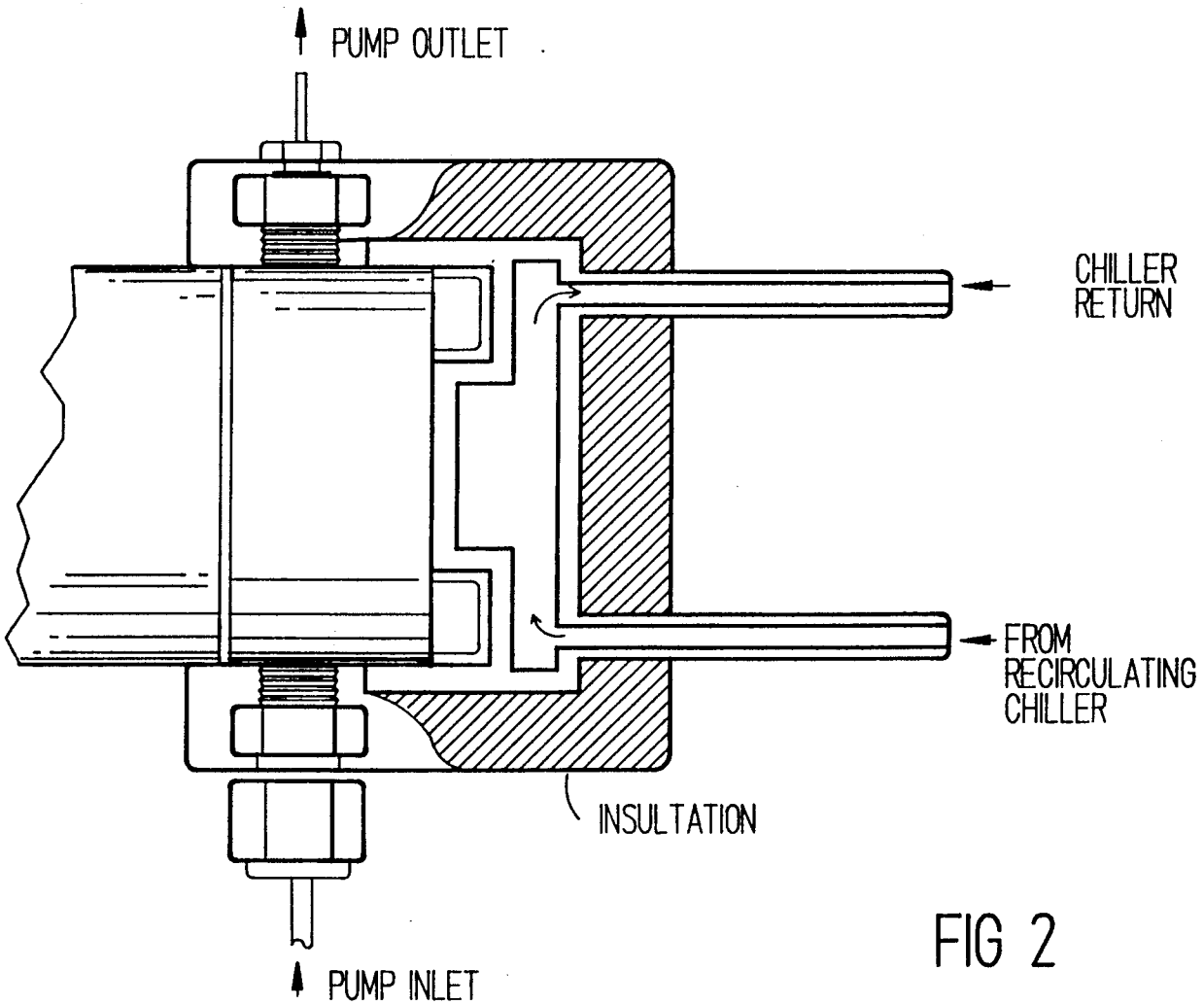
FIG. 2 is a cross sectional view of the pumphead in which the pumping fluid is precooled separately from the pumphead.
Figure 3:
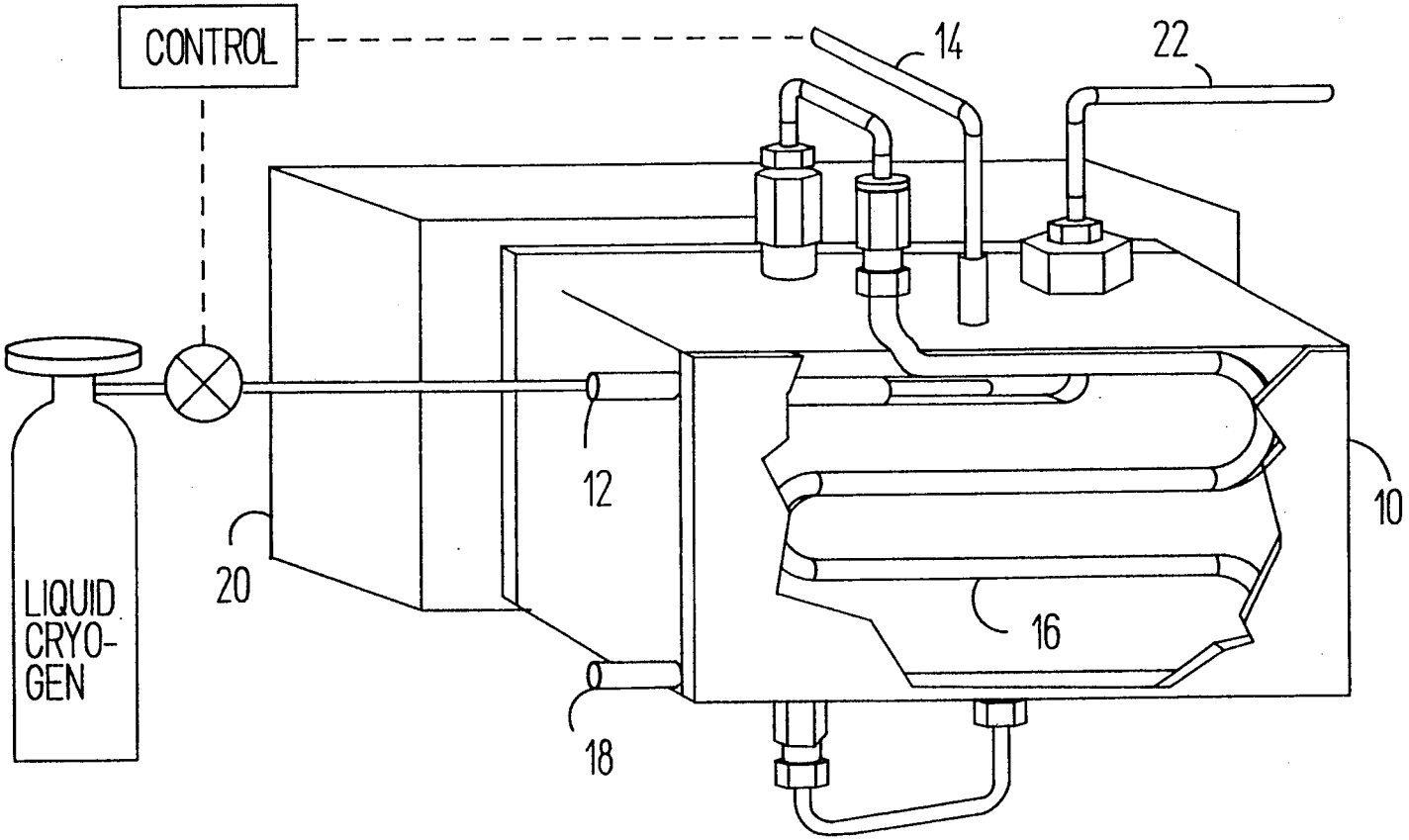
FIG. 3 illustrates a fluid pumping system in accordance to the invention having a single cryogenically cooled heat exchanger integrated into the pump head.

The preferred embodiment of the invention is illustrated in FIG. 3 in which the pump head 10 acts as a heat exchanger such that cryogenic fluid may be supplied to a cryogenic input nozzle 12. The amount of cryogenic fluid supplied is controlled by sensing the actual temperature of the pumphead with a thermocouple 14 and generating an offset signal corresponding to the difference between the actual temperature and the desired temperature. The cryogenic fluid, input into the input nozzle 15, simultaneously cools the precooler supply tube 16, the pumphead 10 and ultimately, the pumping fluid being inputted through the pumping fluid input 18, so as to decrease the compressibility of the pumping fluid. In particular, the pump head 10 includes a pump cylinder made of a material which is capable of withstanding high pressure and which has high thermal conductivity with low mass and low thermal resistance. The pumphead 10 is thermally isolated from the rest of the pump body by thermal insulator 20 to minimize the amount of cooling energy required to maintain the pumping fluid at sub ambient temperatures. The precooler supply tube 16 is thermally coupled to the pumphead 10 such that the pumping fluid is maintained at a thermal equilibrium to prevent losses in pumping efficiency due to heat being supplied to the fluid from external sources at it travels from the heat exchanger to the pump cylinder.

Figure 4:
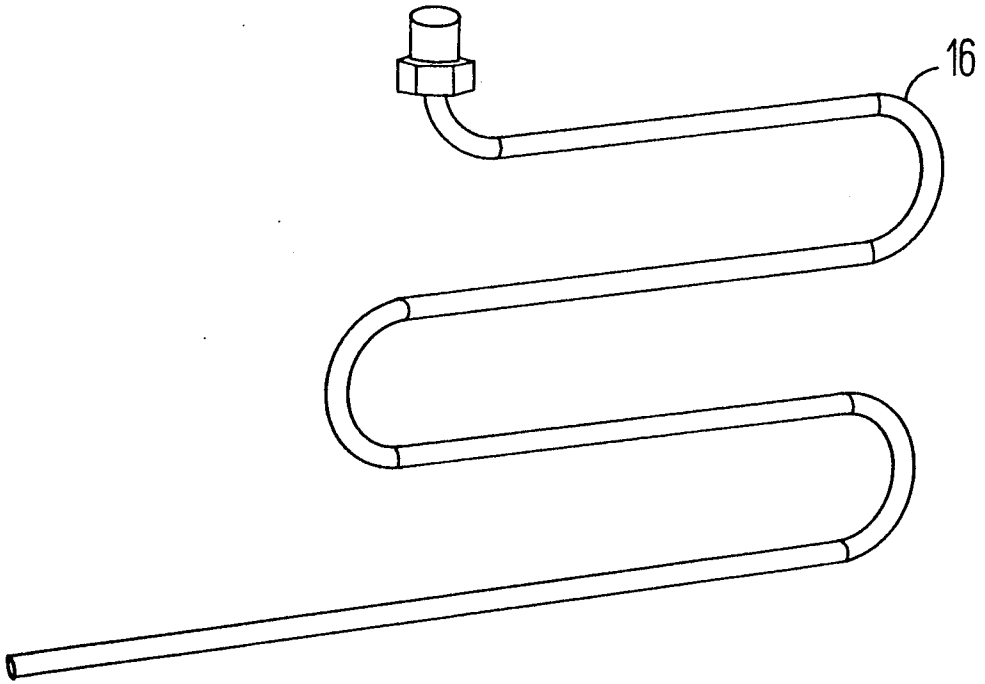
FIG. 4 illustrates curved tubing utilized as the precooler portion of the heat exchanger.

The pre-cooler supply tube 16 is set in, and thermally coupled to, a channel along the top of the pump head (FIG. 3). Since the length of the tube is relatively long in relation to its diameter (FIG. 4), it acts as a heat exchanger and dissipates heat from the pumping fluid to the pump head. Cryogenic fluid inputted into the input nozzle 12 cools down both the pump head and the precooler supply tube 16 to ensure that the pumping fluid is at sub ambient temperatures prior to and during pumping. An accurately controlled thermal environment results in a consistent bulk modulus value as the fluid enters the pump. Additionally, heat is conducted out of the cylinder efficiently to maintain isothermal conditions during the compression cycle and to the pumping fluid outlet 22.

This solvent delivery system can pump compressible fluids to high pressures with accurate metering using one thermally controlled zone. Since the compression stage is now isothermal, the solvent delivery is accurate and the mass flow can be easily calculated using the first law of thermodynamics and mass conservation equations.

Although best results are obtained by the foregoing pumping system method and apparatus, changes and modification of the invention, as set forth in the specifically described embodiments, can be carried out without departing from the scope of the invention which is intended to be limited only by the scope of the appended claims.

We claim:

1. A cryogenically cooled reciprocating pumping system for ensuring that the pumping fluid is maintained at a desired temperature just prior to pumping, comprising:

a pump head; and a pump body coupled to said pump head, wherein, the thermal conductivity of said pump body is lower than he thermal conductivity of said pump head; and heat exchanger means coupled integrally to said pump head; and temperature sensing means for sensing the actual temperature of the pumphead such that said actual temperature can be compared to said desired temperature, wherein an offset signal is generated in response thereto; and cryogenic cooling means for simultaneously cooling both said pump head and said heat exchanger in response to said offset signal.

2. A cryogenically cooled reciprocating pumping system as claimed in claim 1, wherein said heat exchanger means is a curved tube recessed into said pumphead.

3. A cryogenically cooled reciprocating pumping system as claimed in claim 2, wherein, said curved tube is permanently joined together with said pumphead to maximize thermal contact.

4. A cryogenically cooled reciprocating pumping system as claimed in claim 1, further comprising an insulator coupled between said pump head and said pump body, wherein, said insulator insulates said pump head from said pump body and minimizes the amount of cooling energy required to cool said pump head.

* * * * *